United States Patent [19]

Blain

[11] 3,971,290

[45] July 27, 1976

[54] EXPLOSIVE LINEAR CUTTER

[75] Inventor: Jim W. Blain, Santa Cruz, Calif.

[73] Assignee: The United States of America as represented by the Secretary of the Navy, Washington, D.C.

[22] Filed: Sept. 13, 1974

[21] Appl. No.: 505,696

[52] U.S. Cl. ..... 89/1 B; 102/49.5
[51] Int. Cl.[2] ..... B26F 1/26
[58] Field of Search ..... 102/49.5; 89/1 B

[56] References Cited

UNITED STATES PATENTS

| | | | |
|---|---|---|---|
| 3,139,031 | 6/1964 | Schroter et al. | 102/49.5 |
| 3,185,090 | 5/1964 | Weber | 102/49.5 |

*Primary Examiner*—Verlin R. Pendegrass
*Attorney, Agent, or Firm*—R. Sciascia; R. Beers; S. Scheinbein

[57] ABSTRACT

An explosive linear cutter for cutting materials comprising an explosive charge sheathed in a metal covering, a support for said charge surrounding the covering except for a slot facing the target material to be cut. Separation of the target material is effected by propelling a fragment of metal sheath at high velocity through the slot and into the target upon detonation of said explosive charge to thereby achieve a clean highly directional cut along a desired separation line.

This abstract is for the purpose of providing a non-legal brief statement to serve as a searching tool and is not intended to limit the scope of the invention as disclosed herein nor limit the scope or fair meaning of the appended claims.

2 Claims, 3 Drawing Figures

EXPLOSIVE LINEAR CUTTER

BACKGROUND OF THE INVENTION

This invention relates to explosive severance means and particularly to an explosive linear cutter for separating a target material by propelling a high velocity fragment of metal sheath surrounding an explosive core against the target along a separation line.

Explosive actuators wherein an elongated core of explosive material is detonated for separating a device from a missile upon command are known. Many known actuators employ a core of explosive material within an expandable sheath which does not rupture in order to contain the gaseous products of the explosion and prevent contamination of the surrounding region. One such explosive actuator is described in U.S. Pat. No. 3,373,686 granted jointly to myself and A. B. Leaman. Other explosive actuators are described in U.S. Pat. Nos. 3,698,281; 3,661,084; 3,486,410; 3,336,868 and 3,357,356. Some of these known explosive actuators or severance means use shaped charged or grooves in the target material to weaken it at the desired fracture point. When a MDF is mounted adjacent weakening grooves the explosive force goes in all directions and blows the missile skin apart at the groove locations. The Super Zip produces a very broad cutting path with no contamination. The FLSC produces a cut and rupture of the target material with an attendant blast and debris characteristic similar to the MDF but both fail to provide the desired highly directional cutting mechanism with minimum fragmentation and debris contamination required for clearly severing a composite or laminated skin such as high temperature graphite/borite fiberglass materials useful in re-entry bodies. Moreover, the installation of an FLSC is a problem since it must be oriented precisely, otherwise its reliability goes down. Where composite materials are employed as the missile skin or target to be severed, weakening grooves cannot be used, and the MDF undirected explosive force is not sufficiently strong to rupture the composite material reliably.

A very serious problem has arisen in attempting to clearly cut a laminated or composite missile skin made of fibre materials, such as high temperature graphite/-borite fiberglass materials for re-entry bodies. Known cutting or separation actuators such as the MDF (mild detonating fuse), the FLSC (flex-linear shaped charge), and the Super Zip (exemplified by the foregoing patents) U.S. Pat. Nos. 3,373,686 and 3,698,281 have proven unsatisfactory in attempts to very cleanly cut a composite missile skin.

An object of the present invention is to enable the clean separation of a composite skin or laminated body of graphite/fiberglass material with minimum debris and contamination.

Another object is to utilize an MDF explosive core in a modified surrounding metallic tube containing an elongated slot therein registering with a desired severance or separation line, to thereby optimize the explosive force through the slot and generate a very clean highly directional cut in a target material.

A further object is to propel a high velocity fragment of metal through a relatively narrow slot to achieve a clean linear cut in a target.

Other objects and advantages of the invention will appear from a reading of the accompanying description.

BRIEF SUMMARY OF THE INVENTION

The explosive linear cutter of the invention permits a lead-sheathed mild detonating fuse (MDF) to be used reliably with a missile skin to generate a highly directional, very clean cut. The explosive MDF core is surrounded by a corrosion resistance stainless steel tube or sheath which has a slot registering with the separation or severance line of the target material. The detonation front is directed through the slot which has a width approximately equal to but not greater than the diameter of the MDF explosive core. Separation of the target material is effected by propelling a high velocity fragment of sheath metal, or a metal fragment placed within the slot of the same material as the sheath to be fragmented, into the target. The cutter of the invention is a successful device for cutting a high temperature composite or laminated missile skin made for example of fiberglass materials.

BRIEF DESCRIPTION OF THE DRAWING

Throughout the figures of the drawing the same parts are represented by the same reference numerals.

DETAILED DESCRIPTION

Figure 1:
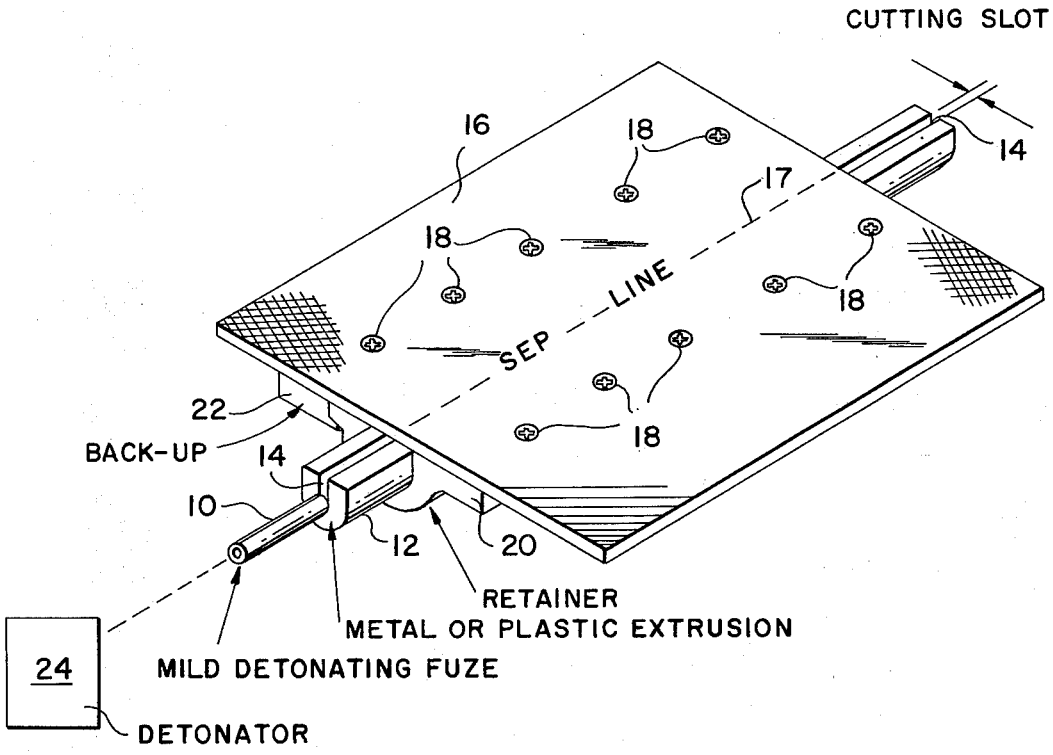
FIG. 1 is a perspective view illustrating an embodiment of the invention.

The explosive linear cutter of the invention comprises a linear shaped explosive charge 10 shown as core of metal-sheathed mild detonating fuse and surrounded by a structure 12 which may be metal or a plastic extrusion except for a slot 14 extending over the length of structure 12 and registering with the severance or separation line 17 of a strip of target material 16. The thickness of the lead sheath 21 surrounding the explosive core will vary with the type and diameter of the core material. The tube 12 may be made from corrosion resistant stainless steel, or a slotted high strength nylon extrusion and may be considered the cutter body. The slot has a width preferably equal at most to the diameter of the MDF core 10. The target plate or strip 16 may be any brittle laminated non-metallic material such as a plurality of laminated layers of fiberglass, for example graphite/Borite fibers fiberglass or graphite cloth laminated with epoxy and cured at high temperature to produce a strong, light-weight, high temperature resistant material. These materials are currently used in missile body construction. If desired, though not preferred, the target plate may be a strip of beryllium, aluminum or magnesium and steel. Any plate materials which is notch sensitive or has low sheer properties are good candidates for the target material 16. The plate or strip 16 may be affixed as by screws 18 to a retainer clamp 20 which supports and holds in place the slotted tube or plastic extrusion 12 with the MDF 10. This retainer may be made from aluminum. A back-up support 22 serves to provide strength and rigidity to the retainer 20.

Any suitable known type of detonating initiator assembly 24 comprising a housing and a detonator or blasting cap therein may be connected to the MDF 10 to produce a shock front traveling down the MDF core 10.

Figure 2:
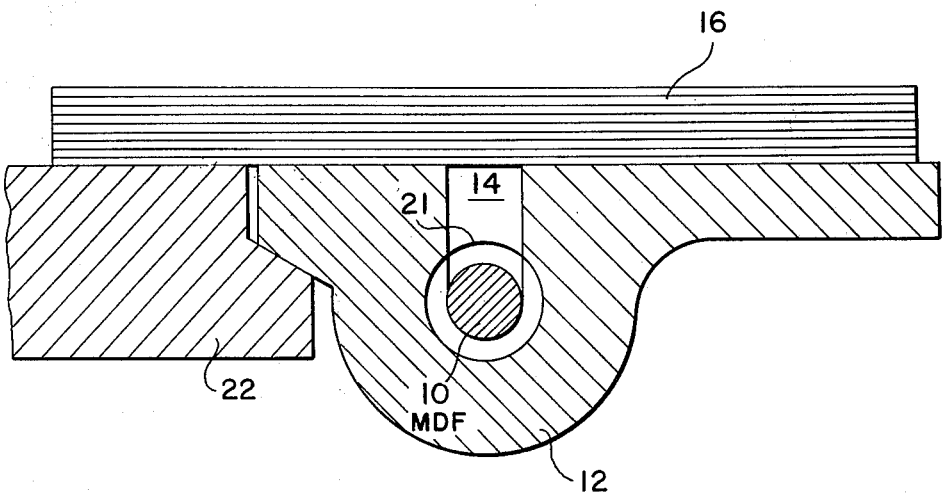
FIG. 2 is a sectional view taken transversely through the structure illustrated in FIG. 1.

FIG. 2 shows the target strip 16 as a composite skin made from nine laminations of graphite/Borite fiberglass materials. Although the slot through the metal tube or nylon extrusion 12 is shown slightly narrower than the diameter of the explosive core 10, the slot 14 preferably has a width equal to diameter of core 10 which is within its metal sheath.

Figure 3:
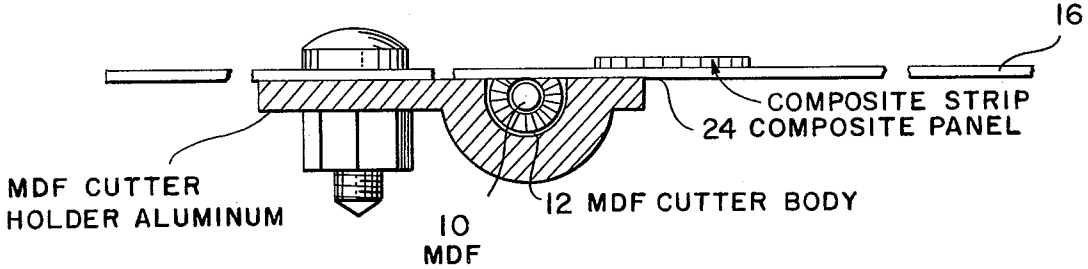
FIG. 3 illustrates a sectional view of a modification of FIGS. 1 and 2 in that the slot in the sheath or tube surrounding the MDF is positioned more closely to the target material.

FIG. 3 is a slight modification of the structure of FIGS. 1 and 2 in that the slot in the tube or extrusion 12 has zero depth and the sheath is directly in contact with (contiguous to) a composite panel directly below the composite target strip or plate 16.

Dimensions are shown in the FIGS. 2 and 3 as merely illustrative of those which may be used.

In the operation of the explosive linear cutter of the invention, actuation of the MDF by detonator 24 will cause the sheath surrounding the MDF core 12 to shatter at the location of the slot 14 and thereby propel a high velocity fragment of the metal sheath surrounding the MDF core through the composite target strip or plate 16. The MDF core may be sheathed with aluminum, lead or silver to produce the desired high velocity fragments when the MDF is ignited. The thickness of the sheath will vary with the type and diameter of the core. If desired, pieces of metal may be placed within the slot below the target. By optimizing the amount of the explosive load and by making the slot width 14 equivalent to the diameter of the explosive core 10 there is generated a very clean highly directional cut through the panel and target.

Test fire results showed the MDF cutter of the invention to be a satisfactory device for severing 3 inch length laminated composite, graphite fiber panels, 0.065 inch thick (nine laminations) without an unacceptable degree of delamination of the composite panel. Solid particle contamination was a minimum. Similar satisfactory results were obtained with the invention when assembled with 18 inch length × 5 inch width × 0.040 inch thick composite panels formed in a 36 inch radius cylindrical section, with MDF, RDX, 5.0 gr/ft aluminum sheath cord. Other tests were conducted with 2.5 gr/ft to 8.0 gr/ft metal sheathed explosive cores having diameters ranging from 0.030 to 0.075 inches diameters. The efficiency and contamination levels were low and the cutter of the invention satisfactorily severed composite laminated panels with a minimum of debris, and was successfully demonstrated as a means of separating a rotating hollow capstan mechanism on a spacecraft application. The capstan is used as a driving shaft for driving another shaft, and when the capstan is severed the driven shaft can then free-wheel. Because of the desirable working properties, HM-31 A-T5 magnesium was used for the capstan body.

There has been described a new and highly desirable way of separating metallic and non-metallic structures, and a technique for cleanly cutting high temperature Borite/graphite laminated structures with minimum damage and contamination. An advantage of the present invention is that it can be placed in a small design envelope adjacent to sensitive components without causing blast damage.

Obviously, many modifications and variations of the present invention are possible in light of the above teachings. It is therefore to be understood that, within the scope of the appended claims, the invention may be practiced otherwise than as specifically described.

What is claimed is:

1. Apparatus for making a clean cut in a composite laminate of graphite/fiberglass material comprising:

cutter means for propelling a high velocity metal fragment into the material to be cut, said cutter means comprising:

an explosive longitudinal core sheathed in a metal covering, said core and said covering having a circular cross section, said covering being adapted to fragment upon firing of said core;

a support extending in a longitudinal direction and having an elongate bore of circular cross section in intimate contact with the core metal cover to encompass it over more than one hundred and eighty degrees of its external surface;

a narrow longitudinal slot with parallel walls having an internal width dimension that is no greater than the diameter of said bore, said slot extending from the bore and forming a spaced opening between a portion of the sheathed core and the material to be cut when the latter is placed upon the support over the slot for cutting by means of a highly directional jet formed from a portion of said sheath and by said slot geometry upon explosion of said core.

2. An explosive core according to claim 1 wherein the diameter of said core is in the range of 0.030 to 0.075 inches.

* * * * *